United States Patent [19]

Edelman

[11] Patent Number: 4,991,737

[45] Date of Patent: Feb. 12, 1991

[54] RECYCLING TRASH BOX

[75] Inventor: Frederick Edelman, Yardley, Pa.

[73] Assignee: Art Kraft Container Corporation, Tullytown, Pa.

[21] Appl. No.: 465,449

[22] Filed: Jan. 16, 1990

[51] Int. Cl.[5] ..... B65D 5/00; B65D 51/18

[52] U.S. Cl. ..... 220/525; 220/553; 220/557; 220/253; 220/254; 220/989; 220/404; 229/120.18; 229/125.01; 229/125.15; 229/127

[58] Field of Search ..... 220/253, 254, 20, 22, 220/23, 1 T, 403, 404, 345; 229/120.11, 120.18, 125.01, 125.14, 125.15, 127

[56] References Cited

U.S. PATENT DOCUMENTS

| | | | |
|---|---|---|---|
| 225,143 | 3/1880 | Kahler | 220/253 X |
| 1,206,535 | 11/1916 | Helson | 229/125.14 X |
| 1,219,176 | 3/1917 | Sharp | 220/1 T X |
| 1,521,255 | 12/1924 | Scheu | 220/22 |
| 2,597,847 | 5/1952 | Reeser . | |
| 2,965,277 | 12/1960 | Prieto | 229/27 |
| 3,145,835 | 8/1962 | Byassee | 229/120.18 |
| 3,510,046 | 5/1970 | Reiner | 229/120.18 |
| 3,720,346 | 3/1973 | Cypher | 220/22.3 |
| 4,164,301 | 8/1979 | Thayer | 220/253 |
| 4,398,661 | 8/1983 | Schillinger . | |
| 4,611,725 | 9/1986 | Kacalieff | 220/253 |
| 4,651,918 | 3/1987 | Moore et al. | 229/27 |

FOREIGN PATENT DOCUMENTS

| | | | |
|---|---|---|---|
| 298176 | 8/1932 | Italy | 220/254 |

*Primary Examiner*—Stephen Marcus
*Assistant Examiner*—Stephen Cronin
*Attorney, Agent, or Firm*—John F. A. Earley; John F. A. Earley, III

[57] ABSTRACT

A recycling trash box for holding different types of trash in separate compartments which comprises a box having a bottom wall, four side walls extending upwardly from the bottom wall, and a top wall positioned above the side walls, the box having an upright center dividing wall attached to and extending between two opposite side walls to form two compartments in the box, and the top wall having openings formed therein to permit trash to be inserted into each of the two compartments.

A plastic disc is rotatably mounted to the top wall for opening and closing the box, and it has an opening near its rim. The box is opened by rotating the disc until the disc opening is aligned with an opening in the top wall of the box, and the box is closed by rotating the disc until the disc opening is not alinged with an opening in the top wall.

9 Claims, 4 Drawing Sheets

RECYCLING TRASH BOX

BACKGROUND OF THE INVENTION

1. Field of the Invention

This invention relates to recycling trash and to boxes for containing the trash which is to be recycled, and more particularly concerns a recycling trash box for holding different types of trash in separate compartments.

2. Description of the Related Art

Many people feel that the world is rapidly approaching a trash crisis, because the world is producing far larger quantities of trash then can be properly disposed of.

In response to the trash crisis, many communities have adopted laws requiring the recycling of certain items, such as glass, plastic, and paper products. These laws require that the trash be sorted out according to type before it is placed outside at the curb for collection. Several containers or trash bags must be used; for example, one container for glass, one for plastic, one for paper, and another for other trash.

Using several containers requires more room and is more difficult than using one. It is also expensive because the user must purchase several different containers. Also, it is more time-consuming to take off and replace the lids of two trash barrels than it is to do that for one barrel.

In recent years, attempts have been made to provide multiple-compartment containers for recycling trash, but these containers are made of plastic or metal, and therefore are relatively expensive.

SUMMARY OF THE INVENTION

It is an object of this invention to provide an inexpensive box for trash that is to be recycled that has multiple compartments and is easy to use.

Another object of the invention is to provide a recycling trash box that is compact in size.

In accordance with these and other objects of the invention, there is shown a recycling trash box for holding different types of trash in separate compartments which comprises a box having a bottom wall, four side walls extending upwardly from the bottom wall, and a top wall positioned above the side walls, the box having an upright center dividing wall attached to and extending between two opposite side walls to form two compartments in the box, and the top wall having openings formed therein to permit trash to be inserted into each of the two compartments.

A plastic disc is rotatably mounted on the top wall for opening and closing the box, and it has an opening near its rim. The box is opened by rotating the disc until the disc opening is aligned with an opening in the top wall of the box, and the box is closed by rotating the disc until the disc opening is not aligned with an opening in the top wall.

DETAILED DESCRIPTION

Figure 1:
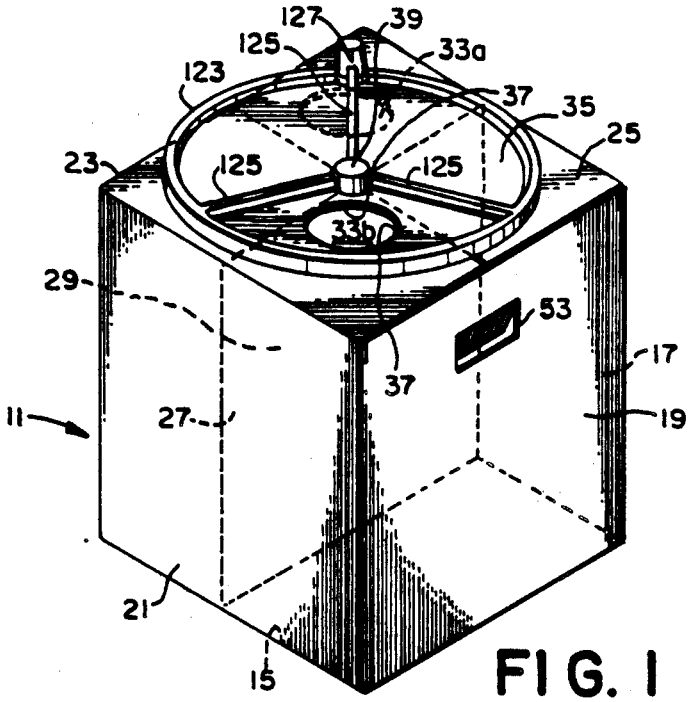
FIG. 1 is a view in perspective of a container constructed in accordance with this invention and shows a plastic disc rotated so that the box is open to receive trash with the disc opening in alignment with a top wall opening.

Turning now to the drawings, there is shown a recycling trash box 11 for holding different types of trash in separate compartments which comprises a bottom wall 15, side walls 17, 19, 21, 23 extending upwardly from bottom wall 15, and a top wall 25 positioned on top of side walls 17, 19, 21, 23. Box 11 has a center dividing wall 27 attached to and extending between opposite side walls 17, 21 to form two compartments 29, 31.

Top wall 25 has openings **33*a*, 33*b* formed therein, with one opening 33*b* formed in the top wall over compartment 29 and one opening 33*a* formed in the top of compartment 31, to permit trash to be inserted into each compartment 29, 31 in box 11 through top wall 25**.

A plastic disc 35 (FIG. 1) having an opening 37 near its rim is rotatable on top wall 25, and means, such as a plastic screw 39 and a washer (not shown), rotatably mount disc 35 on top wall 25. Plastic screw 39 and the washer (not shown) may be a Quik Grip Fastener w/Squeeze Fit screw and washer, QG Series, manufactured by Fasteners For Retail, Cleveland, Ohio, 44143.

Disc 35 may be rotated so that opening 37 in disc 35 is aligned with an opening **33*b* in top wall 25 so that a particular type of trash may be placed in compartment 29, as shown in FIG. 1, or disc opening 37 may be aligned with opening 33*a* of box 11. For example, glass may be collected in compartment 29, and other trash may be collected in compartment 31. When it is desired to throw glass into compartment 29, disc 35 is rotated until disc opening 37 is positioned over the opening to compartment 29**.

Further, disc 35 may be rotated such that its opening 37 is not aligned with either opening **33*a*, 33*b* in top wall 25 to close trash box 11**.

Bottom wall 15 (FIG. 3) is a locked bottom formed from five bottom flaps **41*a*, 41*b*, 43, 45, 47, and top wall 25 is a tuck top formed from three top flaps 49*a*, 49*b*, 51, with an opening 33*a* formed in top flap 49*b* and an opening 33*b* formed in top flap 51**.

Box 13 is preferably made of corrugated paperboard.

Hand holes and flaps 53 are formed in side walls 19 and 23 for providing an easy means to lift and carry trash box 11.

Figure 3:
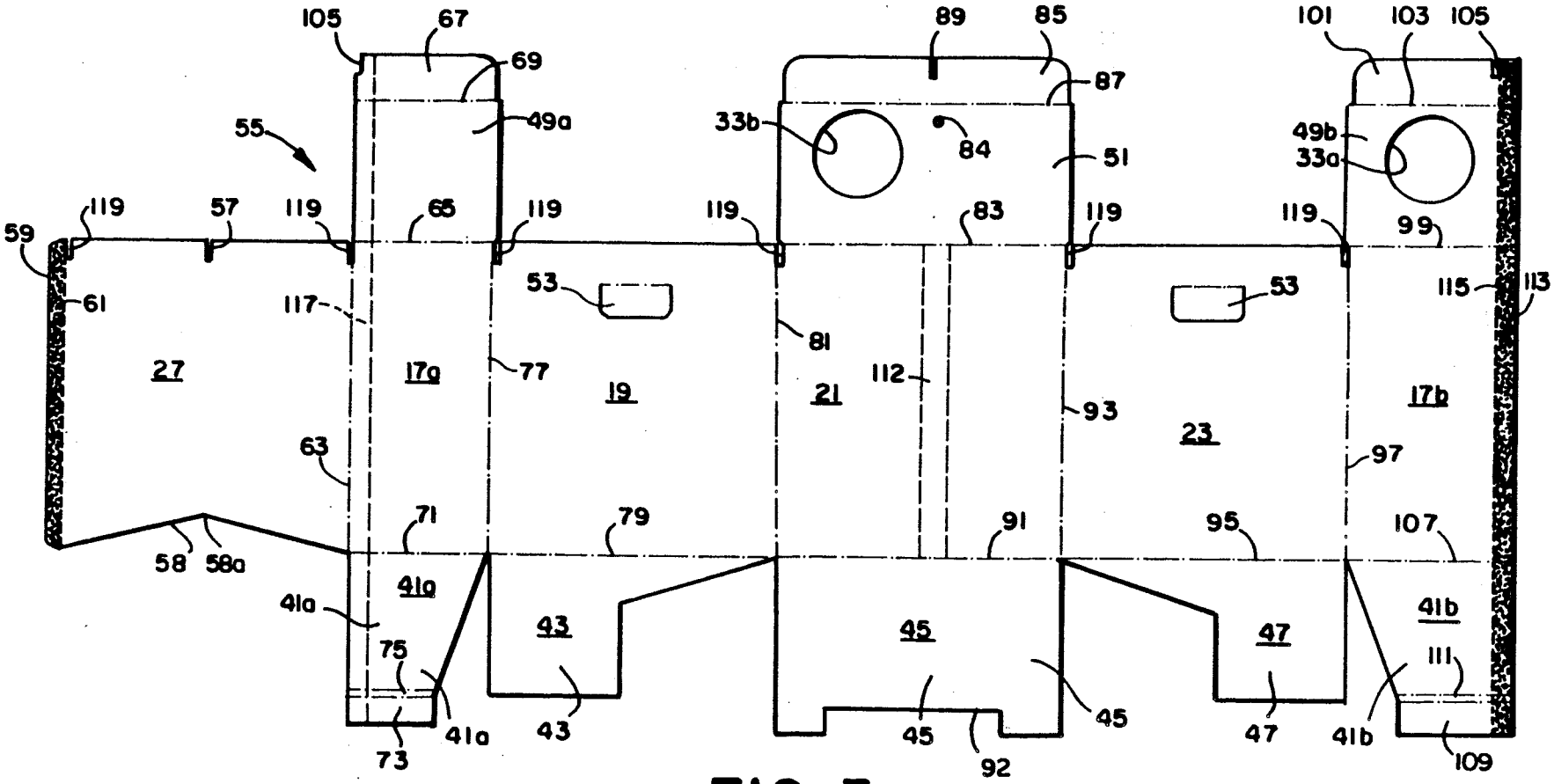
FIG. 3 is a view in top plan of a blank which folds into the box of FIG. 1.
Figure 4:
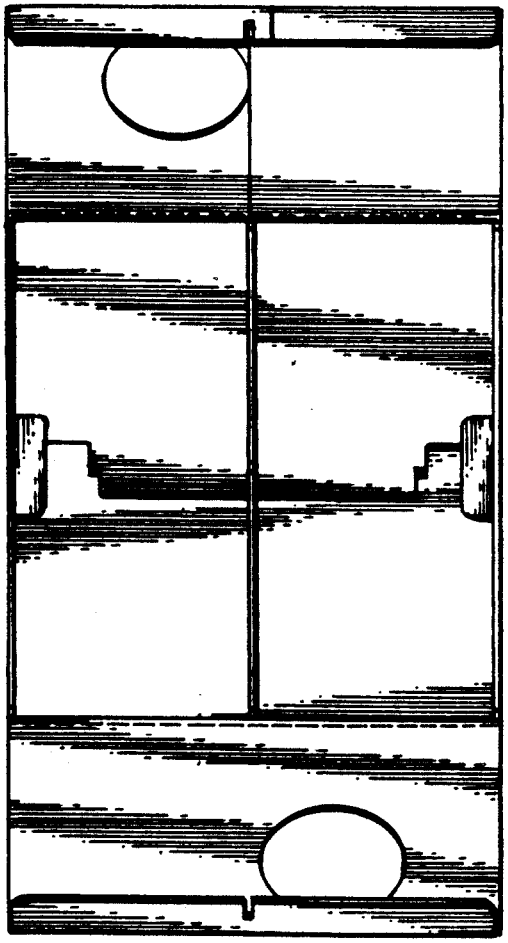
FIG. 4 is a view in top plan of the container in erected condition with the top open to show the interior and to show the structure of the bottom wall.
Figure 5:
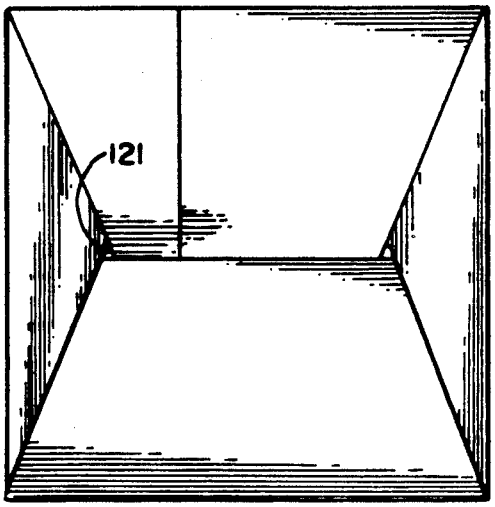
FIG. 5 is a view in bottom plan of the container in erected condition and shows the exterior of the bottom wall.

A blank 55 for forming box 11 is shown in FIG. 3, which includes center dividing wall 27 having a slot 57 formed in its top edge, a cut-out portion 58 formed in its bottom edge with two slanted bottom edges meeting at a notch **58*a*, and a glue flap 59 hingedly attached to center dividing wall 27 along a score line 61 formed along a side edge of center dividing wall 27**.

Side wall panel 17a is hingedly connected to center dividing wall 27 along a score line 63 formed along its side edge. Side wall panel 17a also includes a top flap 49a hingedly attached to the top edge of side wall panel 17a along a score line 65. Top flap 49a includes a tab 67 hingedly connected to the top edge of top flap 49a along a score line 69.

Side wall panel 17a further includes a bottom flap 41a hingedly connected to the bottom edge of side wall panel 17a along a score line 71. A tongue 73 is hingedly attached to the bottom edge of bottom flap 41a along double score line 75.

A side wall 19 is hingedly connected to the side edge of side wall panel 17a along a vertical score line 77. Bottom flap 43 of side wall 19 is hingedly connected to the bottom edge of side wall 19 along a score line 79. One of the hand holes and flaps 53 is formed in side wall 19 near the top.

Side wall 21 is hingedly connected to a side edge of side wall 19 along a score line 81, and side wall 21 includes a top flap 51 hingedly connected thereto along a horizontal score line 83 formed along the top edge of side wall 21. Top flap 51 has a hole 84 formed near its top edge for receiving plastic screw 39. Opening 33b is formed in flap 51 on the left.

A tab 85 is hingedly connected to the top edge of top flap 51 along a score line 87. Tab 85 includes a vertical slot 89 formed in the center of its top edge, and tab 85 is not as wide as top flap 51 and is curved for easy insertion in the tuck top.

Side wall 21 further includes a bottom flap 45 hingedly connected to the bottom edge of side wall 21 along a score line 91, and flap 45 has a long horizontal recess 92 formed along its bottom edge.

Side wall 23 is connected to a side edge of side wall 21 along a score line 93 and includes a bottom flap 47 hingedly connected thereto along a score line 95 formed along the bottom edge of side wall 23.

A side wall panel 17b is hingedly connected to a side edge of side wall 23 along a score line 97. Side wall panel 17b includes a top flap 49b hingedly connected to the top edge of side wall panel 17b along a score line 99.

Top flap 49b includes a tab 101 hingedly connected to the top edge of flap 49b along a score line 103. Tab 101 has a vertical slot 105 formed along its top edge near its right side edge, and its left side edge is recessed and curved for easy insertion in the tuck top.

Top flap 49b further includes the opening 33a formed therein.

Side wall 17b also includes a bottom flap 41b hingedly connected thereto along a score line 107 formed along the bottom edge of side wall 17b. Bottom flap 41b has a tongue 109 hingedly connected to the bottom edge of flap 41b along a double score line 111.

Box 11 is constructed as follows with the understanding that FIG. 3 shows the inside surface of the blank 55 which forms the inside surfaces of the box 11.

Referring to FIG. 3, with blank 55 in a horizontal position with the viewer looking down on it, to assemble the box the side wall 19 is bent upwardly along score line 81 until it is roughly upright and perpendicular to side wall 21, which remains horizontal. Side wall panel 17a is bent downwardly along score line 77 toward side wall 21 until it is roughly horizontal and is perpendicular to side wall 19.

Glue flap 59 is bent along score line 61 until it is perpendicular to center dividing wall 27, and then glue is applied to the inside surface of glue flap 59. Center dividing wall 27 is bent downwardly along score line 63, which places the glue-covered glue flap 59 in close proximity to a center strip 112 of side wall 21. Glue flap 59 is pressed against center strip 112 of side wall 21 and the glue is allowed to dry.

Next, the glue is applied to a strip 115 near edge 113 of blank 55. Glue strip 115 includes the outer edge portions of tab 101, top flap 49b, side wall panel 17b, bottom flap 41b, and tongue 109.

Side wall 23 is bent upwardly along score line 93 until it is perpendicular to side wall 21, and side wall panel 17b is bent downwardly toward side wall 21 along score line 97 until it is horizontal and perpendicular to side wall 23.

Side wall panel 17b now overlaps side wall panel 17a with the glue strip 115 facing downwardly toward a reception strip 117. Reception strip 117, which is on the other side of the view of blank 55 in FIG. 3, includes portions of tab 67, top flap 49a, side wall panel 17a, bottom flap 41a, and tongue 73. Glue strip 115 is pressed against reception strip 117, with side wall panel 17b being pressed against side wall panel 17a to form a joint side wall 17a, 17b, with top flap 49b pressed against top flap 49a to form a joint top flap 49a, 49b, with tab 101 pressed against tab 67 to form a joint tab 67, 101, with bottom flap 41b pressed against bottom flap 41a to form a joint bottom flap 41a, 41b, and with tongue 109 pressed against tongue 73 to form a joint tongue 73, 109. The glue is allowed to dry.

At this point, the side walls 17a, 17b, 19, 21, 23 of box 13 have been formed Bottom wall 15 of box 11 is formed in the following manner. Bottom flap 45 is folded upwardly along score line 91 until it is perpendicular to side wall 21. Next, bottom flap 43 is folded along score line 79 to overlap bottom flap 45, and bottom flap 47 is folded along score line 95 to overlap bottom flap 45.

Joint tongues 73, 109 are folded along score lines 75, 111. Joint bottom flaps 41a, 41b are folded along score lines 71, 107 until they come close to bottom flap 45, at which point joint tongues 73, 109 are inserted in slot 121 in bottom wall 45 formed by the edge of recess 92 in flap 45 and the edges of flaps 43 and 47, and pulled through to lock the bottom wall together. Joint tongues 73, 109 fit under cut-out portion 58 of center dividing wall 27 to form a lock bottom.

Top wall 25 of box 13 is formed in the following manner. Tabs 67, 101 are folded downwardly along score lines 69, 103, and joint top flaps 49a, 49b are folded downwardly along score lines 65, 99 until the flaps are perpendicular with the joint side wall formed by side wall panels 17a, 17b. The joint tab formed by tabs 67, 101 is secured to center dividing wall 27 by inserting tabs 67, 101 into box 11 so that vertical slot 105 of tabs 67, 101 mate with slot 57 in center dividing wall 27.

Similarly, tab 85 is folded toward the viewer along score line 87, and top flap 51 is folded along score line 83 until it is perpendicular to side wall 21. Tab 85 is inserted into box 11 so that vertical slot 89 mates with slot 57 in center dividing wall 27 to complete the formation of top wall 25.

After the box 11 is erected, openings 33a, 33b are located in opposite corners of top wall 25 with opening 33a positioned over compartment 31, and opening 33b positioned over compartment 29. Plastic disc 35 is attached to box 11 by a plastic screw 39 through top flap 51.

Box 11 further includes a plurality of notches 119 around the top edge of the side walls. The purpose of notches 119 is to allow trash bags or some other trash receptacle to be securely inserted in compartments 29, 31.

Figure 2:
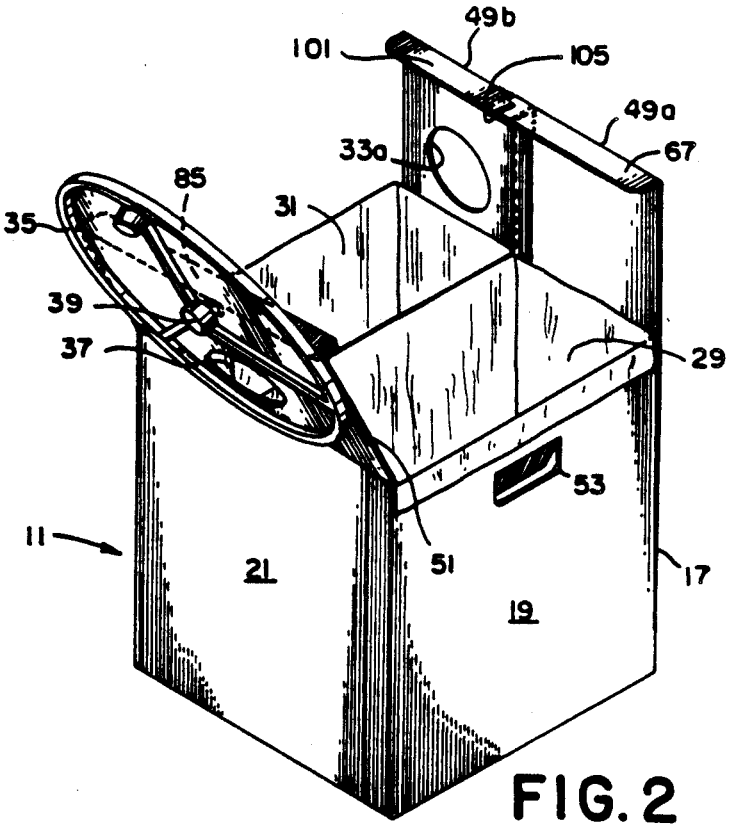
FIG. 2 is a view in perspective of the container of FIG. 1 with the flaps of the top wall folded open to reveal two compartments inside the box.

In operation, the user of trash box 11 lifts the top flaps and inserts a trash bag and secures the trash bag therein by folding the top portions of the trash bag into notches 119 as shown in FIG. 2. Then he inserts another trash bag into the other compartment in the same manner. He closes the top flaps, and he rotates disc 35 so that disc opening 37 is positioned over a solid portion of top wall 25 to close the box 11.

Compartment 29 may be designated, for example, for glass, and compartment 31 may be designated for plastic. When it is desired to throw out glass bottles, he rotates disc 35 until disc opening 37 is positioned over opening 33*a*, and inserts the glass bottles into compartment 29. Similarly, to dispose of plastic bottles, he rotates disc 35 until disc opening 37 is positioned over opening 33*b*, and he inserts the plastic bottles into compartment 31.

When compartment 29 or compartment 31 is full, he lifts the top flaps, pulls out the full trash bag and carries it out to the curb for collection, and he places a new trash bag into the appropriate compartment.

Plastic disc 35 is provided with a support ridge 123 at its circumference, and with three other support ridges 125 that extend across its top surface. Plastic disc 35 is also provided with a handle 127 to facilitate turning of plastic disc 35.

Figure 6:
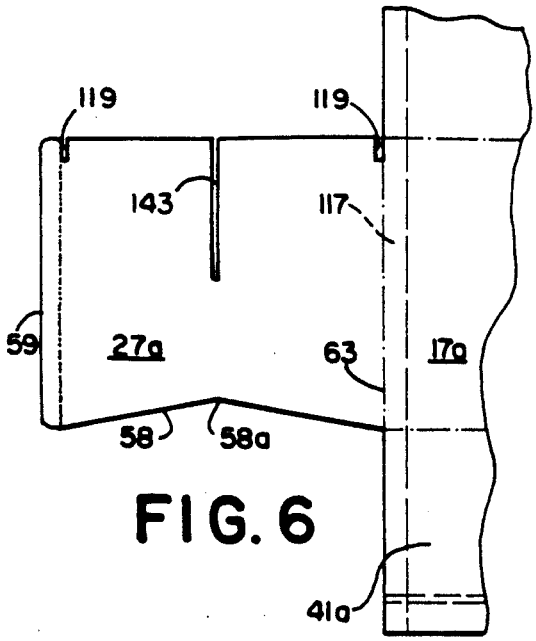
FIG. 6 is a partial view in top plan of an alternative embodiment of a blank showing a modified center dividing wall.
Figure 7:
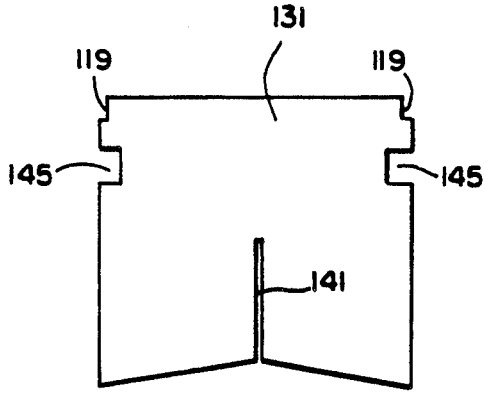
FIG. 7 is a view in front elevation of the cross dividing wall.
Figure 8:
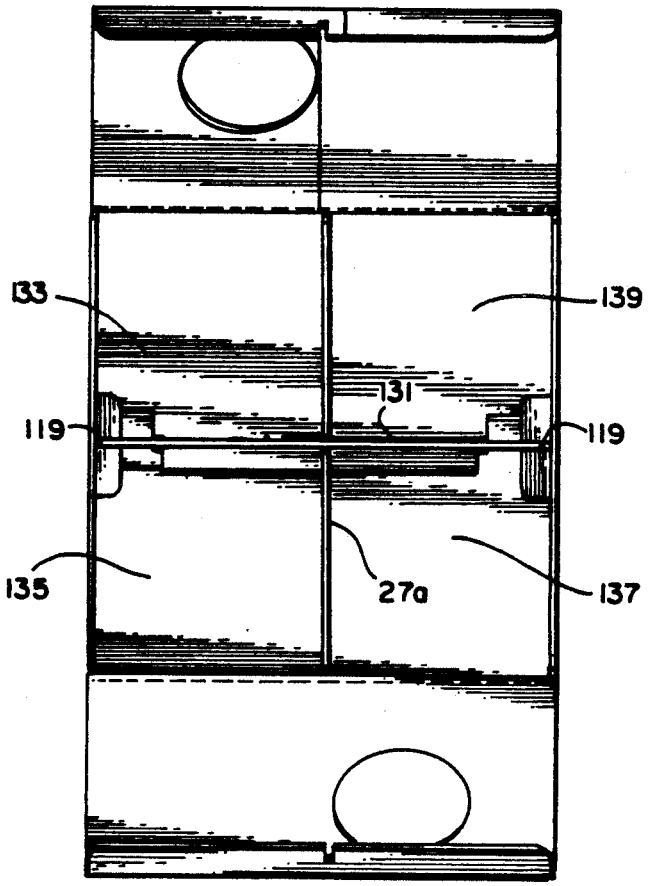
FIG. 8 is a view in top plan of the container in erected condition with the top open to show the interior and to show the structure of the bottom wall.

A cross dividing wall 131, as shown in FIGS. 6,7 and 8, may be used to create four compartments 133, 135, 137, and 139. Cross dividing wall 131 is provided with a slit 141 that interlocks with elongated slot 143 of center dividing wall 27*a* (center dividing wall 27*a* being a modification of center dividing wall 27) to secure cross dividing wall 131 to center dividing wall 27*a*.

Cross dividing wall 131 is provided with notches 119 for facilitating lining compartments 133, 135, 137, and 139 with plastic bags. Further, cross dividing wall 131 is provided with recesses 145 that are aligned with hand holes and flaps 53 when cross dividing wall 131 is inserted in box 11 to create sufficient hand space.

I claim:

1. A recycling trash box for holding different types of trash in separate compartments comprising a box having a bottom wall, four side walls extending upwardly from the bottom wall, and a top wall positioned on top of the side walls, the box having a center dividing wall attached to and extending between two opposite side walls to form two compartments in the box, the top wall having an opening formed therein above each compartment to permit trash to be inserted into each compartment, a disc mounted on the top wall and having an opening near its rim, and means for rotatably mounting the disc on the top wall to open and close the box whereby the box is opened by rotating the disc opening into alignment with an opening in the top wall, and whereby the box is closed by rotating the disc to a position where the disc opening is not aligned with an opening in the top wall.

2. The recycling trash box of claim 1, the bottom wall being a lock bottom formed from five flaps.

3. The recycling trash box of claim 1, the top wall being a tuck top formed from three flaps, with an opening formed in two of the flaps.

4. The recycling trash box of claim 1, the box being made of corrugated paperboard.

5. The recycling trash box of claim 1, the box having hand holes formed in opposite side walls thereof.

6. The recycling trash box of claim 1, the disc being made of a synthetic plastic.

7. The recycling trash box of claim 1, the disc mounting means including a synthetic plastic screw and washer.

8. A recycling trash box for holding different types of trash in separate compartments comprising a box having a bottom wall, four side walls extending upwardly from the bottom wall, and a top wall positioned on top of the side walls, the box having a center dividing wall attached to and extending between two opposite side walls to form two compartments in the box, the top wall having an opening formed therein above each compartment to permit trash to be inserted into each compartment, a disc mounted on the top wall and having an opening near its rim, and means for rotatably mounting the disc on the top wall to open and close the box, whereby the box is opened by rotating the disc opening into alignment with an opening in the top wall, whereby the box is closed by rotating the disc to a position when the disc opening is not aligned with an opening in the top wall, the bottom wall being a lock bottom formed from five flaps, the top wall being a tuck top formed from three flaps, with an opening formed in two of the flaps, the box being made of corrugated paperboard, the box having hand holes formed in the walls thereof, the disc being made of synthetic plastic, and the disc mounting means including a synthetic plastic screw and washer.

9. A blank for forming a recycling trash box for holding different types of trash in separate compartments comprising a center dividing wall having a slot formed in the top edge thereof, a first side wall hingedly attached along a first side edge to a first side edge of the center dividing wall, a first top flap hingedly attached to the top edge of the first side wall, a first tab hingedly attached along the top edge of the first top flap, a first bottom flap hingedly attached to the bottom edge of the first side wall, a first tongue hingedly attached to the bottom edge of the first bottom flap, a second side wall hingedly attached along a first side edge to a second side edge of the first side wall, a second bottom flap hingedly attached to the bottom edge of the second side wall, a third side wall hingedly attached along a first side edge to a second side edge of the second side wall, a second top flap having an opening formed therein and hingedly attached to the top edge of the third side wall, a second tab hingedly attached along the top edge of the second top flap, a third bottom flap having a slot formed along its bottom edge and hingedly attached to the bottom edge of the third side wall, a fourth side wall hingedly attached along a first side edge to a second side edge of the third side wall, a fourth bottom flap hingedly attached to the bottom edge of the fourth side wall, a fifth side wall hingedly attached along a first side edge to a second side edge of the fourth side wall, a third to flap having an opening formed therein and hingedly attached to the top edge of the fifth side wall, a third tab hingedly attached along the top edge of the third top flap, a fifth bottom flap hingedly attached to the bottom edge of the fifth side wall, and a second tongue hingedly attached to the bottom edge of the fifth bottom flap, whereby the walls of the box are formed by attaching the second side edge of the center dividing wall to the center of the third side wall and joining the fifth side wall and the first side wall in an overlapping relationship to form a joint side wall that forms a side wall of the box, whereby the bottom wall is formed by joining the fifth bottom flap and the first bottom flap in an overlapping relationship to form a joint bottom flap, joining the first tongue and the second tongue in an overlapping relationship to form a joint tongue, folding the third bottom flap until it is perpendicular to the third side wall, folding the second bottom flap 43 over the third bottom flap, folding the fourth bottom flap over the third bottom flap, folding the joint bottom flap over the second and fourth bottom flaps and inserting the joint tongue of the joint bottom flap through the slot in the third bottom flap to secure the bottom flaps together, and forming the top wall by joining the third top flap and the first top flap to form a joint top flap joining the first tab and the third tab to form a joint tab and folding the joint top flap and inserting the joint tab into the slot in the center dividing wall and folding the second top flap and inserting the second tab into the slot in the center dividing wall.

* * * * *